US006092629A

United States Patent [19]

Bohnert et al.

[11] Patent Number: 6,092,629

[45] Date of Patent: Jul. 25, 2000

[54] SERVICE STATION ISLAND TRANSACTION TERMINAL

[75] Inventors: Michael H. Bohnert, Fort Wayne, Ind.; Ronald R. Lien, Brea, Calif.

[73] Assignee: Atlantic Richfield Co., Los Angeles, Calif.

[21] Appl. No.: 08/834,535

[22] Filed: Apr. 5, 1997

Related U.S. Application Data

[63] Continuation-in-part of application No. 08/566,012, Dec. 1, 1995, Pat. No. 5,797,470.

[51] Int. Cl.[7] ..... G07F 7/08

[52] U.S. Cl. ..... 186/53; 194/350

[58] Field of Search ..... 186/36, 41, 53; 235/381; 194/206, 207, 350, 904; 312/97.1; 232/15, 16

[56] References Cited

U.S. PATENT DOCUMENTS

| | | | |
|---|---|---|---|
| 792,296 | 6/1905 | Townsend | 312/97.1 |
| 3,931,497 | 1/1976 | Gentile et al. | 235/381 |
| 4,395,627 | 7/1983 | Barker et al. | 235/381 |
| 5,251,738 | 10/1993 | Dabrowski | 194/206 |

*Primary Examiner*—F. J. Bartuska

*Attorney, Agent, or Firm*—Sheldon & Mak; Denton l. Anderson

[57] ABSTRACT

The invention provides an island transaction terminal having a receiver for requesting purchases of fuel at a specified dispensing fuel pump, a receiver for receiving payments for such fuel purchases in the form of money or money equivalent and a signal emitter for emitting a first payment signal containing information regarding the amount of payment received, the form of payment and the specified dispensing pump for which each fuel purchase is requested. The island transaction terminal has a vertical bore so that the island transaction terminal can be securely affixed to a rigid post by attaching the island transaction terminal around the post, such that the post is disposed within the bore.

9 Claims, 11 Drawing Sheets

SERVICE STATION ISLAND TRANSACTION TERMINAL

CROSS-REFERENCE TO RELATED APPLICATIONS

The present application is a continuation-in-part of an application Ser. No. 08/566,012, now U.S. Pat. No. 5,797,470 filed on Dec. 1, 1995, entitled "System for Transacting Fuel Purchases Using an Island Transaction Terminal," the disclosure of which is expressly incorporated herein by reference. The present application is related to an application Ser. No. 08/565,994 also filed on Dec. 1, 1995, entitled "Method and Memory for Transacting Fuel Purchases using an Island Translation Terminal," the disclosure of which is also expressly herein incorporated by reference.

FIELD OF THE INVENTION

The present invention relates to a system for transacting fuel purchases using an island transaction terminal and, in particular, using an island transaction terminal comprising a cash payment acceptor and a non-cash payment acceptor.

BACKGROUND OF THE INVENTION

Prior to pay-at-the-pump technology, gasoline service stations were typically equipped with an attendant-operated terminal for manually transacting fuel purchases. This type of terminal was ordinarily situated in a central location, normally the sales office, and self-service customers were required to pay for gasoline at this location. So long as each fuel dispensing pump was "enabled," that is, ready for pumping without attendant intervention, to purchase gasoline, a customer merely had to park his car at one of the fuel islands, pump the gasoline and then walk to the central location to pay for the gasoline purchase.

However, the problem of "drive-offs" often required service station operators to avoid leaving the fuel dispensers in a normally enabled state. A "drive-off" occurred whenever a car refueling at a remote, enabled fuel dispenser drove off without paying for the gasoline. This situation led to the installation of equipment to remotely enable the fuel dispensers from the central location and requiring the customer to make a pre-payment for gasoline before the attendant enabled the fuel dispenser.

As a result, the customer now had to park his car at one of the fuel islands and walk to the central location to tender pre-payment by cash, debit card, credit card and the like. After making the pre-payment, the customer would walk back to the fuel island and dispense the gasoline. After the fuel dispensing was done, the customer would return to the central location to complete the sales transaction by obtaining any change due, picking up a cash receipt, signing a credit card slip or performing any similar action. The procedure was time consuming and inconvenient to the customer and frequently resulted in lost sales to the service station operator.

Consequently, the option for paying for fuel purchases at the pump without the need to walk to the central location for pre-payment or post-pumping wrap-up has become increasingly popular to the motoring public. Such a point of sale system allows for payment using a customer credit card and can automatically enable fuel dispensers directly from a fuel island. Such systems are described in U.S. Pat. Nos. 4,395,626 and 4,395,627, both issued to Barker et al. on Jul. 26, 1983. The Barker devices provide a step forward in the art of permitting self-vending of fuel, self-payment and self-enablement of individual fuel dispensers by the customer. The Barker devices, however, do not accept cash and are limited to accepting customer credit cards and the like. A customer desiring to pay for a fuel purchase with cash must still make two trips to the central location for pre-payment and for obtaining any change due and a receipt.

There are several problems in equipped such pay-at-the-pump terminals with cash acceptors. First, most fuel dispensers are available in either single or multiple product configurations for selling one or more grades of gasoline. Although the housings of these dispensers can be modified to incorporate pay-at-the-pump terminals, their limited size, especially those of the single product varieties, often make it difficult to add further feature modules, such as cash acceptors.

In addition, cash acceptors typically include a removable cartridge into which received paper currency is stored for later retrieval by authorized personnel. Equipping every fuel dispensing pump with a cash acceptor is very expensive and creates a substantial potential for robbery during the cash cartridge retrieval process. Armored security car companies can perform this function and their insurance premiums are based, in part, on the number of individual locations at which a cash pickup must be made. Since each individual pump constitutes a single pickup location, the insurance premiums for armored car pickup at each individual pump become significant and make cash pickup commercially impracticable.

Where the system for transacting fuel purchases includes an island transaction terminal, a frequent problem arises because the island transaction terminal is vulnerable to being physically removed from the island. Other problems exist because existing island transaction terminals require an excessive amount of time for removal of accrued cash. This results in excessive danger for the individual authorized to remove accrued cash and higher cost to the service station operator.

Therefore, what is needed is an improved separate, free-standing, customer-operable point-of-sale terminal providing a cash payment acceptor and non-cash payment acceptor, such as a debit or credit card acceptor, situated on each fuel dispensing island for transacting fuel purchases for a plurality of fuel dispensing pumps without requiring the customer to travel unnecessarily back and forth between the fuel dispensing island and the central location.

SUMMARY OF THE INVENTION

The present invention is directed to a system for transacting fuel purchases using an island transaction terminal that satisfies this need. The invention is an island transaction terminal and a system for transacting fuel purposes. The island transaction terminal comprises means for receiving a request for purchasing fuel at a specified dispensing pump, means for receiving payments for such fuel purchase in the form of money or money equivalent and means for emitting a first payment signal containing information regarding the amount of payment received, the form of payment and the specified dispensing pump for which such fuel purchase is requested. The island transaction terminal defines a vertical bore, so that the island transaction terminal can be securely affixed to a rigid post at the island location by attaching the island transaction terminal around the post, such that the post is disposed within the bore.

In a preferred embodiment, the island transaction terminal is constructed in two sections, each defining a portion of the vertical bore. The two sections are secured to one another after a vertical post is disposed within the bore.

In another preferred embodiment, the means for receiving payments within the island transaction terminal comprises a cash box cartridge which can be quickly removed and replaced with an identical cash box cartridge. Still more preferably, the cash box cartridge is disposed within a lockable first chamber having a lockable inner door and wherein the first chamber is disposed within a lockable second chamber having a lockable outer door.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
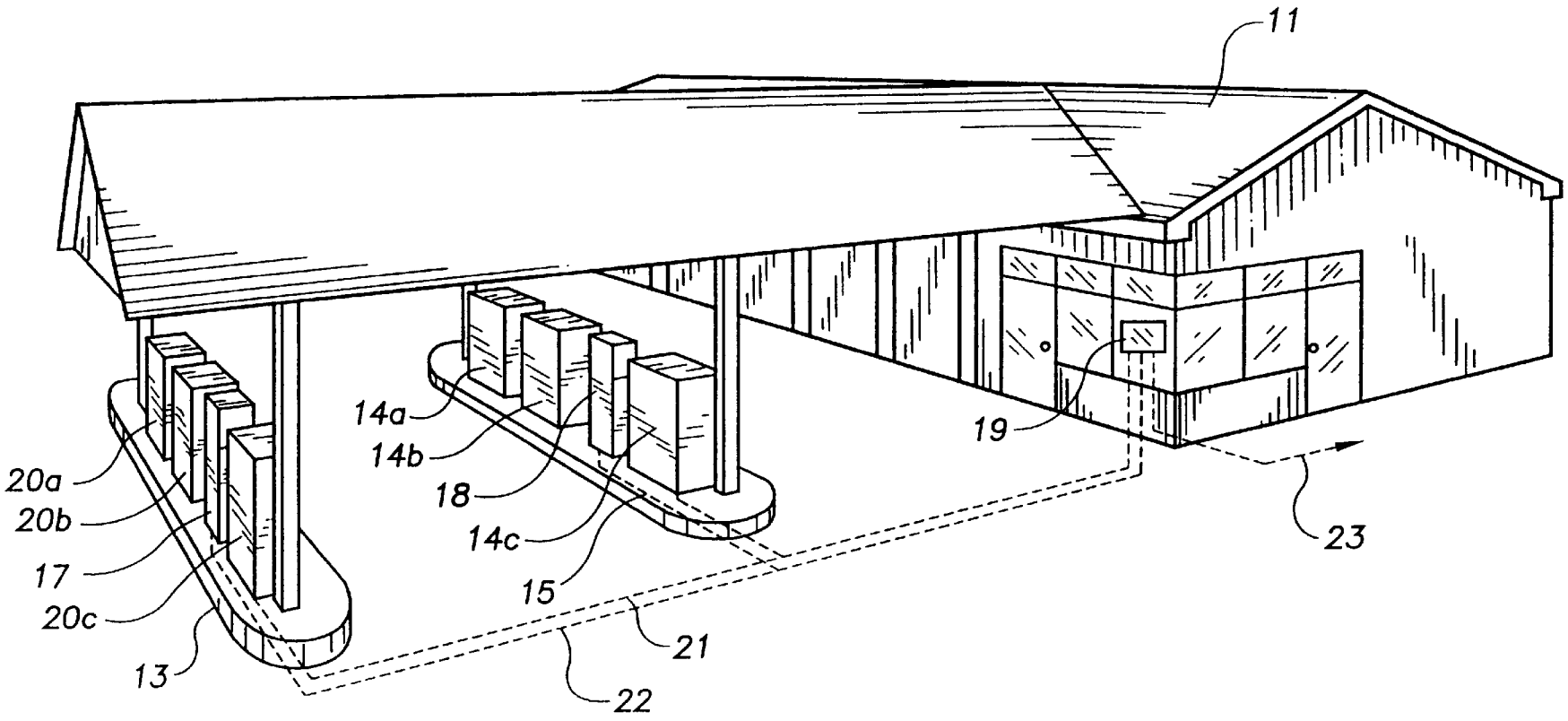
FIG. 1 is a perspective view of a gasoline service station useable in the present invention.

FIG. 1 is a perspective view of a gasoline service station 11 useable in the present invention and having two fuel islands 13 and 15. Each fuel island is shown comprising three separate fuel dispensers 14*a*, 14*b*, 14*c*, 20*a*, 20*b*, 20*c*, although any number of dispensers may also be used. Each dispenser is conventional in the art and is capable of remote enablement from a central terminal 19 positioned within gasoline station 11 or from an island transaction terminal 17. Each dispenser has at least one fuel dispensing outlet for dispensing a particular grade and type of fuel, for example, diesel, unleaded premium or regular gasoline, etc., independently of each of the other dispensers, and has a sensor for detecting when the dispersing operation has completed, for instance, when the dispenser nozzle has been returned to the housing. In the described embodiment, the fuel dispensers 14*c*, 20*a*, 20*b*, 20*c* are of the single or dual product dispenser type wherein each hose dispenses only a single or two kinds of fuel, although other types of fuel dispensers may also be used.

Figure 3:
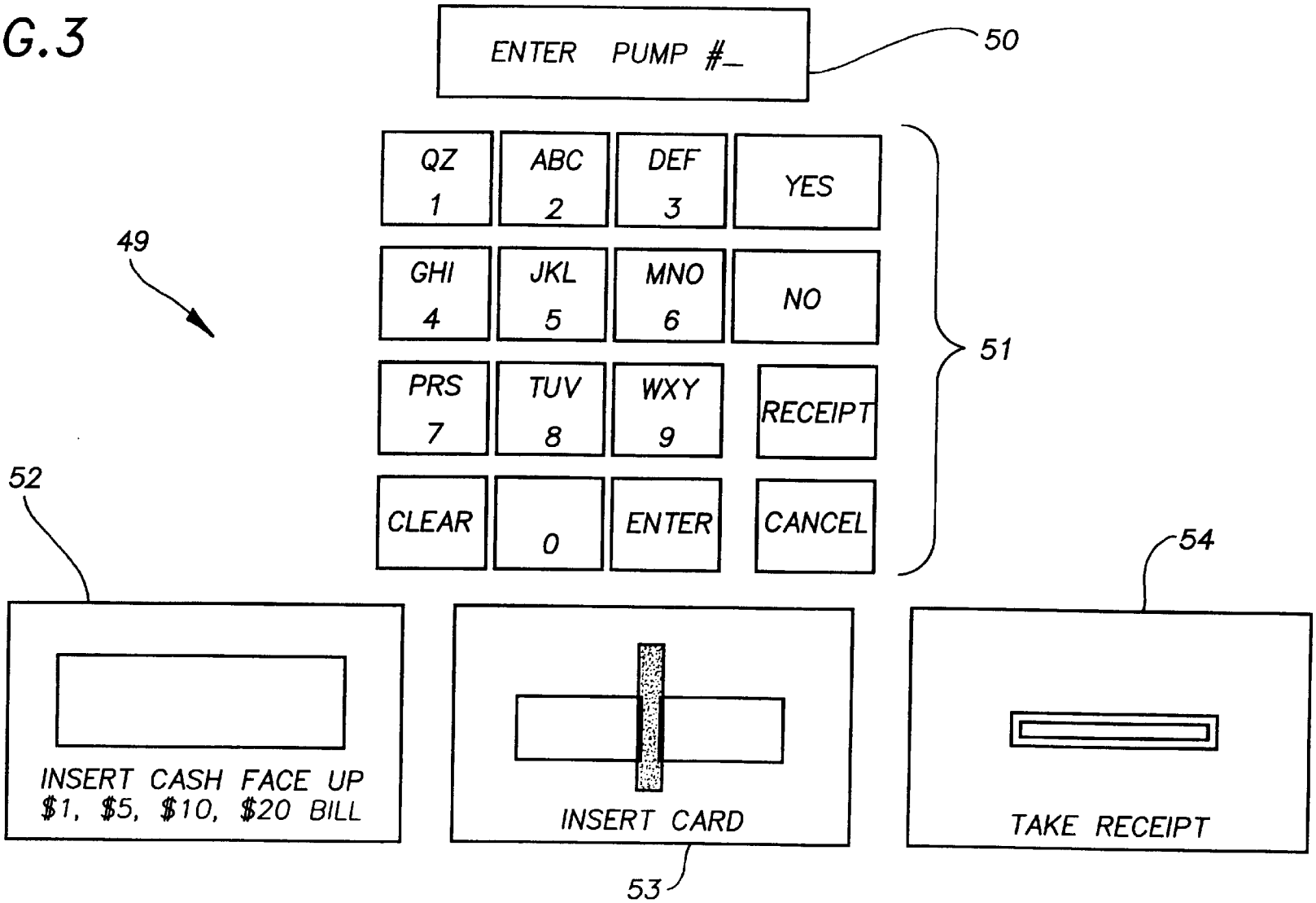
FIG. 3 is a side view of a point-of-sale terminal for an island transaction terminal useable in the invention.

In addition, each fuel island 13, 15 has an island transaction terminal 17, 18 for controlling fuel dispensers and preferably comprising back-to-back point-of-sale terminals. Island transaction terminals 17, 18 are each shown as a free-standing housing situated independently from the structure of the gasoline station 11 and from the fuel dispensers. Preferably, the island transaction terminals can also be installed around a support post, such as one of the support posts for the canopy covering the fuel islands. Each island transaction terminal preferably comprises two point-of-sale terminals, such as shown in FIG. 3, on opposite sides of the housing. Preferably, the island transaction terminal is positioned within each fuel island with the point-of-sale terminals oriented transverse to the flow of automobile traffic through the fuel islands. This enables a customer to step onto a fuel island and out of the flow of traffic and thereby ensures safe operation of the island.

Underground cables 16*a*, 16*b*, 16*c*, 21*a*, 21*b*, 21*c* provide communication between the central terminal 19 and each of the fuel dispensers 14*a*, 14*b*, 14*c*, 20*a*, 20*b*, 20*c* and underground cables 22*a*, 22*b* provide communication between the central terminal 19 and each of the island transaction terminals 17, 18. A transmission cable 23 connects the central terminal 19 to an off-site terminal (not shown) for transmission and receipt of credit, debit and related sales information.

Figure 2:
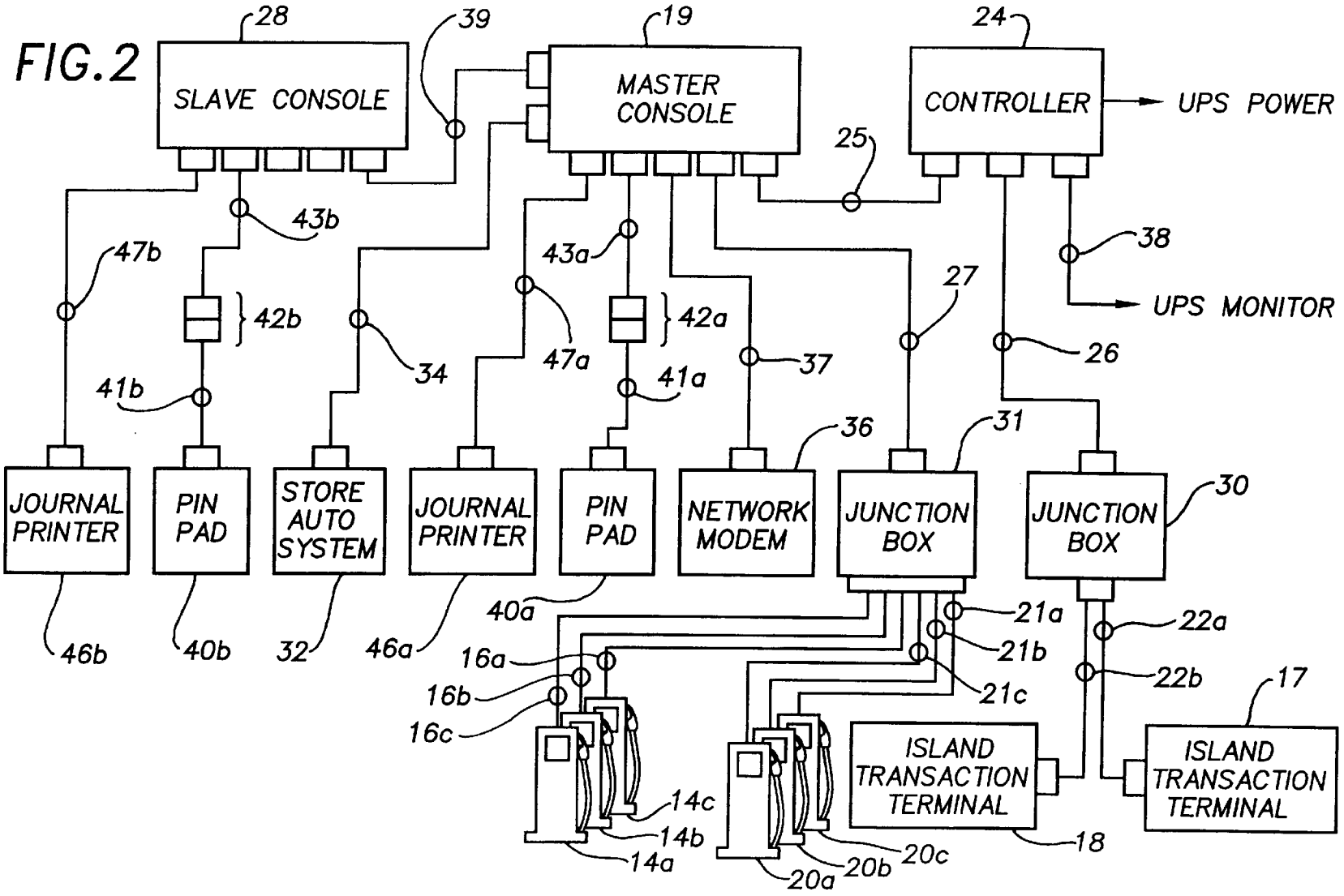
FIG. 2 is a functional block diagram of an embodiment useable in the present invention.

FIG. 2 shows a functional block diagram of an embodiment useable in the present invention. The primary control hub is provided by the central master terminal 19 which acts as the master control console and performs several functions. First, it performs the cash registering functions associated with the sale of gasoline and merchandise, including accepting cash, debit cards, credit cards and the like, using a built-in keypad, alphanumeric display and associated logic (not shown). This includes remotely enabling the fuel dispensers for dispensing fuel upon attendant request. The back panel of the central master terminal 19 is equipped with a plurality of serial ports for connecting the central master terminal 19 to various devices. Each of these serial ports is associated with a different function, although in practice, every serial port might not necessarily be in use or might perform identical functions.

A slave terminal 28 is connected to the central master terminal 19 for providing a second attendant-controlled console to the attendant or an assistant via serial cable 39. The slave terminal 28 performs basically identical cash registering functions, including remote pump enablement, except that the central master terminal 19 acts as the master console for receipt journaling purposes and resolves fuel dispenser reservation conflicts. A similar set of serial ports is also provided on the slave terminal 28.

Pin pad 40*a* is connected to central master terminal 19 and pin pad 40*b* is connected to the slave terminal 28 for enabling customers to enter PIN codes at each console. The PIN codes are used in conjunction with the debit cards, credit cards and similar transactions wherein a security code is required for card authorization. Connectors 42*a*, 42*b* are provided on the ends of serial cables 41*a*, 41*b*, 43*a*, 43*b* to provide easy disconnect of the pin pads 40*a*, 40*b* from the central master terminal 19 and the slave terminal. An example of a suitable pin pad for use with the consoles in this embodiment is a Verifone Model 201 Pin Pad, manufactured by Suntronic Technology Group, Crystal Lake, Ill.

Journal printers 46*a*, 46*b* are also connected to the central master terminal 19 and the slave terminal 28 via serial cables 47*a*, 47*b*, respectively, for printing out specific accounting information accumulated throughout each day, week, month or other particular time period established by the operator of the gasoline station. The journal printers 46*b*, 46*b* are conventional in the art, such as described in U.S. Pat. No. 4,199,100 issued to Wostl et al. on Jun. 8, 1978, the disclosure of which is hereby expressly incorporated herein by reference.

A network modem 36 is connected to the central master terminal 19 via a serial cable 37 for interfacing the central master terminal 19 to an off-site terminal via the transmission cable 23 (not shown) for verifying debit cards, credit cards and the like. One useful system is describe din U.S. Pat. No. 4,395,627 issued to Barker et al., the disclosure of which is hereby expressly incorporated herein by reference.

A store automation system 32 is connected to the central master terminal 19 via a serial cable 34 for recording the POS transactions and providing an accounting to a remote centralized host computer.

Each of the fuel dispensers 20*a–c*, 14*a–c* are connected to the central master terminal 19 through a junction box 31 into which the serial cable 27 and the underground cables 21*a–c*, 16*a–c* are connected, however, other means of interconnecting the central master terminal 19 to the fuel dispensers may also be used.

Preferably, a controller device 24 interfaces the central master terminal 19 to the island transaction terminals 17, 18 by providing protocol translation and status and control signal transmissions. It will be appreciated, however, by one of ordinary skill in the art, that the circuitry required to perform the protocol translation may be included in the central master terminal 19 and thereby eliminating the need for a controller device. The controller device 24 interfaces with the central master terminal 19 through serial cable 25. A junction box 30 into which serial cable 26 and underground cables 22*a*, 22*b* are connected is provided to connect the controller device 24 to the island transaction terminals 17, 18. Other forms of interconnected the controller device 24 to the island transaction terminals may also be used.

Preferably, the controller device 24 is connected to an uninterruptable power supply (UPS) (not shown) for providing standby power to the controller device 24 in case of power outage. A serial cable 28 is connected to the UPS for monitoring the status of the power source. The UPS indicates to the controller device 24 over the serial cable 28 the occurrence of a power outage and subsequent transferral to battery backup power.

FIG. 3 is a side view of a POS terminal 49 for the island transaction terminal. It comprises a liquid crystal display (LCD) 50, a key pad 51, a cash acceptor 52, a card reader 53, and a receipt printer 54, all devices which are conventional in the art. In the described embodiment, the LCD 50 has 4 lines with 20 characters each and the keypad 51 has 16 keys. Other sizes of displays and keyboards are equally acceptable so long as they incorporate the functionality recited herein. Other suitable arrangements of the components shown may also be used.

Figure 4:
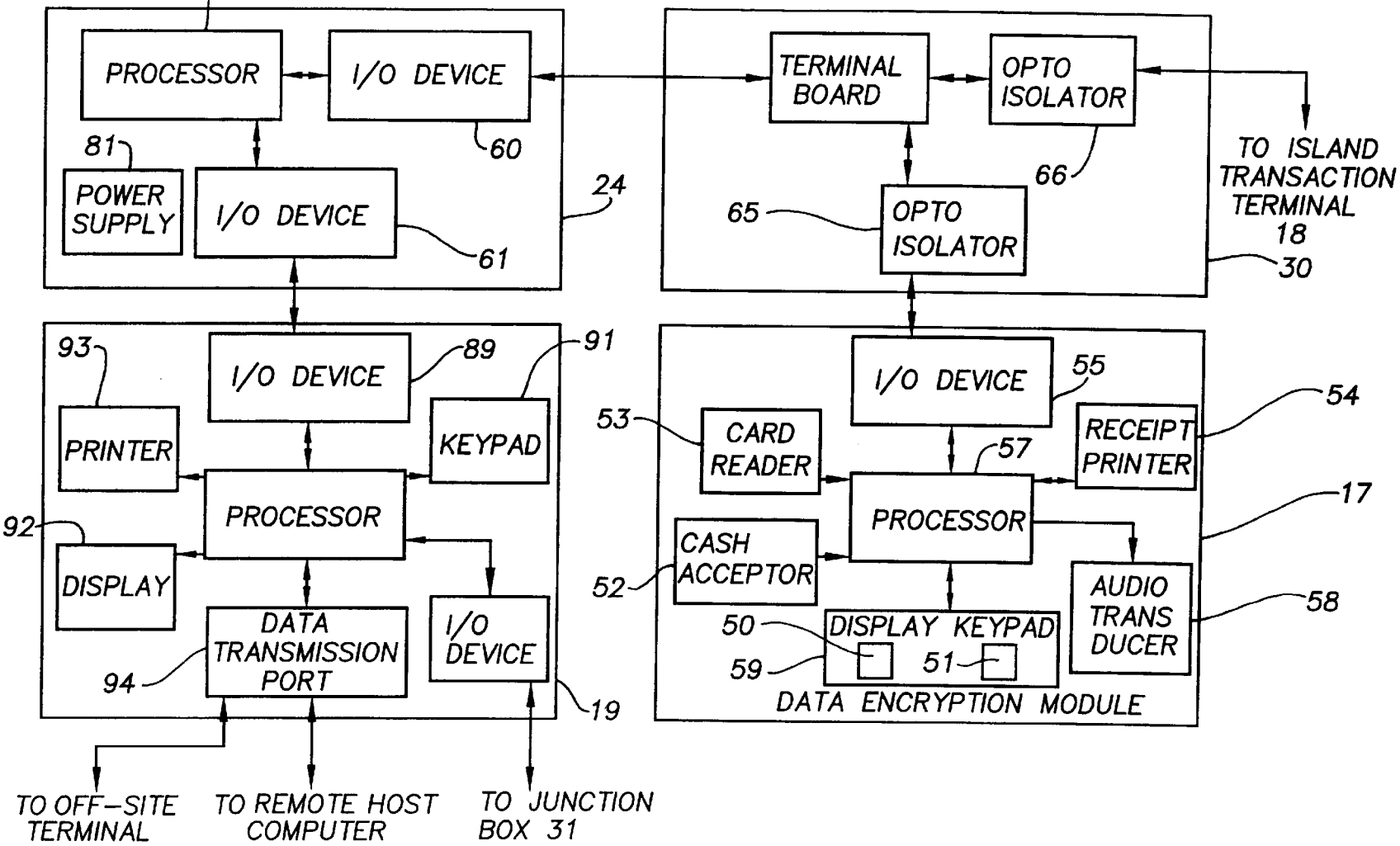
FIG. 4 is a functional block diagram illustrating the operation of one island transaction terminal with a central terminal useable in the invention.

FIG. 4 is a detailed functional block diagram illustrating the communications process between the controller device 24 and one island transaction terminal 17. The island transaction terminal 17 is preferably implemented with a conventional processor such as an 8-bit parallel bus Z80 Microprocessor having an ALU (Arithmetic and Logic Unit), a plurality of registers, including an instruction register memory and a CPU (Central Processing Unit) for interpretation and execution of micro-level assembly instructions (not shown).

The processor 57 is configured to interface with several peripheral devices which are interconnected by means of a cable or bus. The peripheral devices include the cash acceptor 52, the magnetic card reader 53, the receipt printer 54, an audio transducer 58 and a data encryption module 59. In the described embodiment, the magnetic card reader 53 enables a customer to use a debit card, however, credit cards and "smart" cards may also be used. Also, the cash acceptor 52 accepts and stores cash; however, a combination cash acceptor/cash dispenser may also be used to both accept cash and to provide cash back directly at the island. Both the cash acceptor 52 and the magnetic card reader 53 are configured as input devices to the processor 57. The cash acceptor 52 includes a sealed cash compartment for receiving and storing cash payments. A key or other mechanism known in the art is required to control access the cash compartment. The receipt printer 54 is configured to input paper status signals to the processor 57 and the processor sends print messages to the receipt printer 54. In the described embodiment, the receipt printer 54 is equipped with a tear bar (not shown) for manually tearing a printed receipt out of the receipt printer 54. However, the receipt printer 54 can optionally be equipped with an automatic receipt cutter for cutting a printed receipt upon command from the processor 57. To aid the operation of the POS terminal 49, an audio transducer 58 is preferably provided for providing auditory feedback to a consumer during use.

The peripheral devices provide user interface between the island transaction terminal and the fuel dispensers. The processor 57 enters into a control sequence for the execution of a fuel dispenser enablement request in response to a keypad entry indicating the selected fuel dispenser to be used by the consumer. The control sequence is enabled when a cash or a non-cash payment is tendered through one of the peripheral devices. During the enablement of the control sequence, the processor 57 provides visual readback to the display 50 to assist the consumer in completing the transaction.

To interact with an off-site terminal, such as a commercial data bank provider, for verifying debit card and credit card transactional information, the LCD 50 and the key pad 51 are preferably integrated into the data encryption module 59 conforms to the derived unique key per transaction (DUKPT) data encryption standard. When a consumer enters a PIN using the key pad 51, the data encryption module 59 encodes the key strokes and sends the encoded PIN as an encrypted packet to the processor 57.

An I/O (Input/Output) device 55 is connected to the processor 57 for executing the fuel dispenser enablement request control sequence with the central master terminal 19. The I/O device 55 may be implemented to provide direct serial communications with the central master terminal 19 or, alternatively, establish a communications link through the junction box 30 and the controller device 24.

In the embodiment employing the controller device 24, a processor 80 polls each island transaction terminal 17, 18 to determine whether a fuel dispenser enable request control sequence has been executed. The processor 80 may be implemented with a conventional microprocessor, such as an Intel 80386 Microprocessor manufactured by Intel Corporation and supported by RAM (random access memory) and a PROM (programmable read only memory) (not shown). The preferred size of RAM is one megabyte and the PROM is used for storing firmware operating instructions. The processor provides an addressing scheme to each island transaction terminal to ensure that only one island transaction terminal is enabled at a time and to control the transmitting and listening periods of the island transaction terminal being polled. An image of the fuel dispenser reservations from each island transaction terminal is stored in RAM for later transmission to the central master terminal 19. The fuel dispenser reservations stored in RAM further provide a mechanism for precluding a subsequent consumer from selecting the same fuel dispenser previously reserved by another. Each time a fuel dispenser enable request is received from the island transaction terminal, the processor 80 checks RAM to determine whether the requested fuel dispenser has been previously selected. In the event it has, the processor transmits an appropriate message to the island transaction terminal 17 where it is displayed to the consumer on the LCD 50. If the requested fuel dispenser has not been selected, the processor 80 stores the fuel dispenser image in RAM reserving the dispenser for that consumer. Once the consumer completes dispensing fuel, the fuel dispenser reservation in RAM is deleted.

A serial data communication link is established between the island transaction terminal 17 and the controller device 24 via I/O devices 55, 60. Typically, the I/O devices 55, 60 comprise a USART (Universal Synchronous and Asynchronous Receiver and Transmitter) operating in conjunction with one or more line drivers and receivers (not shown). Preferably, a unidirectional interface employing differential line drivers and receivers capable of driving a twisted pair or twisted pair shielded line a long distance. An Rs-485 physical-layer protocol which conforms to the Electronic Industries Association (EIA) standards is well suited for this application.

The I/O devices 55, 60 may perform data packaging in either a synchronous or asynchronous format. In one embodiment, a synchronous interface is established using either a separate transmission line for the data clock or, alternatively, an encoding technique that allows the clock to be extracted from the data. In the embodiment employing a controller device 24 for interfacing the central master terminal 19 with two or more island transaction terminals 17, 18, the simplest synchronous approach is a polled master/slave protocol, such as an SDLC (Synchronous Data Link Control) protocol.

Figure 5:
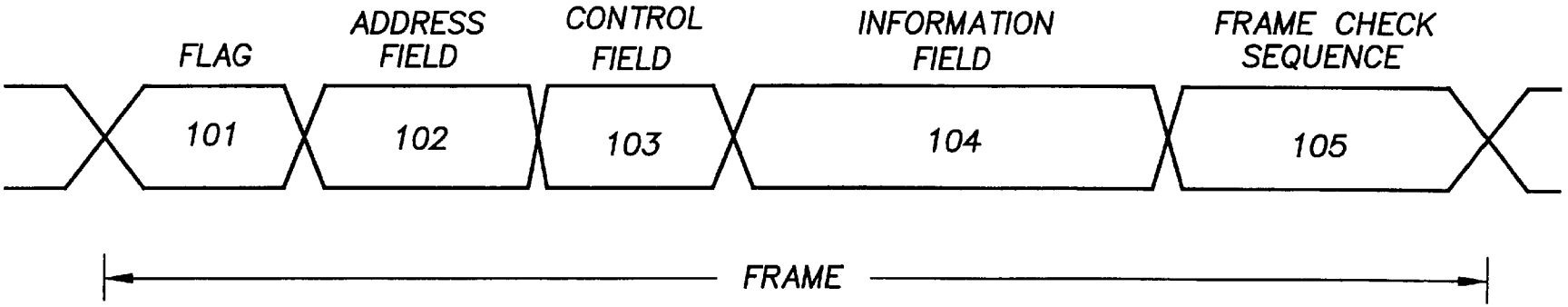
FIG. 5 is a diagram illustrating a standard protocol for an embodiment of a communication data link useable in the invention.

The SDLC protocol is conventional in the art, such as described in U.S. Pat. No. 4,395,627 issued to Barker et al., the disclosure of which has been previously incorporated herein by reference. Briefly, the basic unit of transmission is a frame. As shown in FIG. 5, each frame begins and ends with a flag pattern 101 which define the boundaries of the frame. An address field 102 identifies the island transaction terminal to be polled. A control field 103 indicates the type of frame being transmitted. The data transmission occurs in the information frame 104. Finally, a frame check sequence is provided for error detection. Other types of frames include supervisory and nonsequenced which provide network control functions.

In the embodiment employing the SDLC protocol, the processor 80 provides master control and periodically polls each island transaction terminal. The island transaction terminals are allowed to transmit data only in response to a poll from the processor 80 and thereby eliminates the potential for contention.

The I/O device 55 of each island transaction terminal includes recognition circuitry of its own island transaction terminal address so that it can accept or reject the SDLC frame coming from the controller device. Each control field generally carries a sequence number which allows the receiver to determine if any frames are missed and to identify any frames that need to be retransmitted. The control field also includes a poll/final bit which is set only during the transmission of the last frame to indicate the end of the transmission. The control frame is transparent to the I/O device and routed directly to the processor 57. When the processor 57 detects a set poll/final bit, it responds with a supervisory frame that indicates whether all the frames were received without error, and if not, it specifies which frames should be retransmitted.

In an alternative embodiment, an asynchronous data communication line may be established between the controller device 24 and the island transaction terminals 17, 18. Several conventional off the shelf products currently exist which may be used to implement the controller device 24 using an asynchronous protocol. An example of a suitable controller device 24 for use in this embodiment is a Model SI-1000 Dispenser Authorization Terminal Controller manufactured by Suntronic Technology Group, Crystal Lake, Ill. A custom protocol for interfacing with the SI-1000 would be used in this embodiment. This protocol is available from Tokheim Corporation, Fort Wayne, Ind.

Preferably, a junction box 30 is provided for splitting the transmission line out from the controller device 24 to the island transaction terminals 17, 18. A pair of conventional opto isolators 65, 66 are employed to isolate the island transaction terminals 17, 18 and to minimize the induced noise on the communications lines. It will be appreciated that alternative isolation circuits may be employed such as transformers or the like. A junction box 31 suitable for use in this embodiment is a 67B interface box manufactured by Tokheim Corporation, Fort Wayne, Ind.

The controller device 24 manages the transactions between the island transaction terminals 17, 18 and the central master terminal 19. I/O devices 61, 89 establish a serial communications link between the controller device 24 and the central master terminal 19. For simplicity, the I/O 61, 89 devices can be constructed using the same standard logic levels and protocols as the communications link between the island transaction terminals 17, 18 and the controller device 24. This topology reduces the complexity of the design since each I/O device 55, 60, 61, 89 can be the same.

A processor 90, similar to that employed in the island transaction terminal, is the primary control hub. The processor 90 is configured to interface with several peripheral devices which are interconnected by means of a cable or bus. In the described embodiment, the peripheral devices include an I/O device 89, a keypad 91, an LCD 92, a printer 93 and a data transmission port 94. The keypad 91 and LCD 92 allow the attendant to perform the cash registering functions associated with the sale of gasoline and merchandise, including accepting cash, debit cards, credit cards and the like, at the central master terminal 19. In addition, the processor 90 provides automated management of the transactions enabled at the island transaction terminals received via the I/O device 89. An example of a suitable console for use in this embodiment is the SM-960 Control Console manufactured by Suntronic Technology Group, Crystal Lake, Ill. When used in conjunction with the SI-1000, a custom protocol available through Suntronic Technology Group will be required. The SM-960 may be configured either as a master or slave terminal.

The data transmission port 94 provides for communication with an off-site terminal (not shown) for transacting certain types of sales. Typically, when a debit or credit card is received by the card reader of the island transaction terminal, account information is extracted therefrom and transmitted to the central master terminal 19 in the information frame of the SDLC protocol. The account information is coupled to the microcomputer 90 which generates a message for display at the island transaction terminal. The processor 90 then enters a subroutine for transmitting the account information to the off-site terminal via the transmission cable 23 (not shown) as described in U.S. Pat. No. 4,199,100 issued to Wostl et al. on Jun. 8, 1978, the disclosure of which has previously been incorporated herein by reference. After data transmission, the processor 90 enters into a wait mode for credit authorization from the off-site terminal.

The off-site terminal comprises memory for storing account information from which the validity of accounts can be determined. By way of example, if the off-site terminal is a centralized data bank serving several service stations from a remote location, then the off-site terminal may store each account number together with an indication of whether the account is valid or invalid. The off-site terminal provides to the microcomputer a debit or credit card validation indicative of the debit or credit validity state. The microprocessor 90 processes the data transmitted from the off-site terminal to determine whether credit has been authorized as described in U.S. Pat. No. 4,199,100. A particular message is generated by the microprocessor 90 for display at the island transaction terminal depending on whether or not the credit or debit transaction has been authorized. Assuming that the transaction has been approved, the microprocessor 90 generates an authorized quantity of fuel to be dispensed. Alternatively, the microprocessor 90 generates an authorized quantity of fuel to be dispensed directly from the data transmitted to the central master terminal 19 from the island transaction terminal when the consumer uses the cash acceptor to initiate the transaction or from the keyboard 91 for attendant enabled fuel dispensing. The authorized quantity of fuel corresponding to the payment is stored in memory (not shown).

Figure 6:
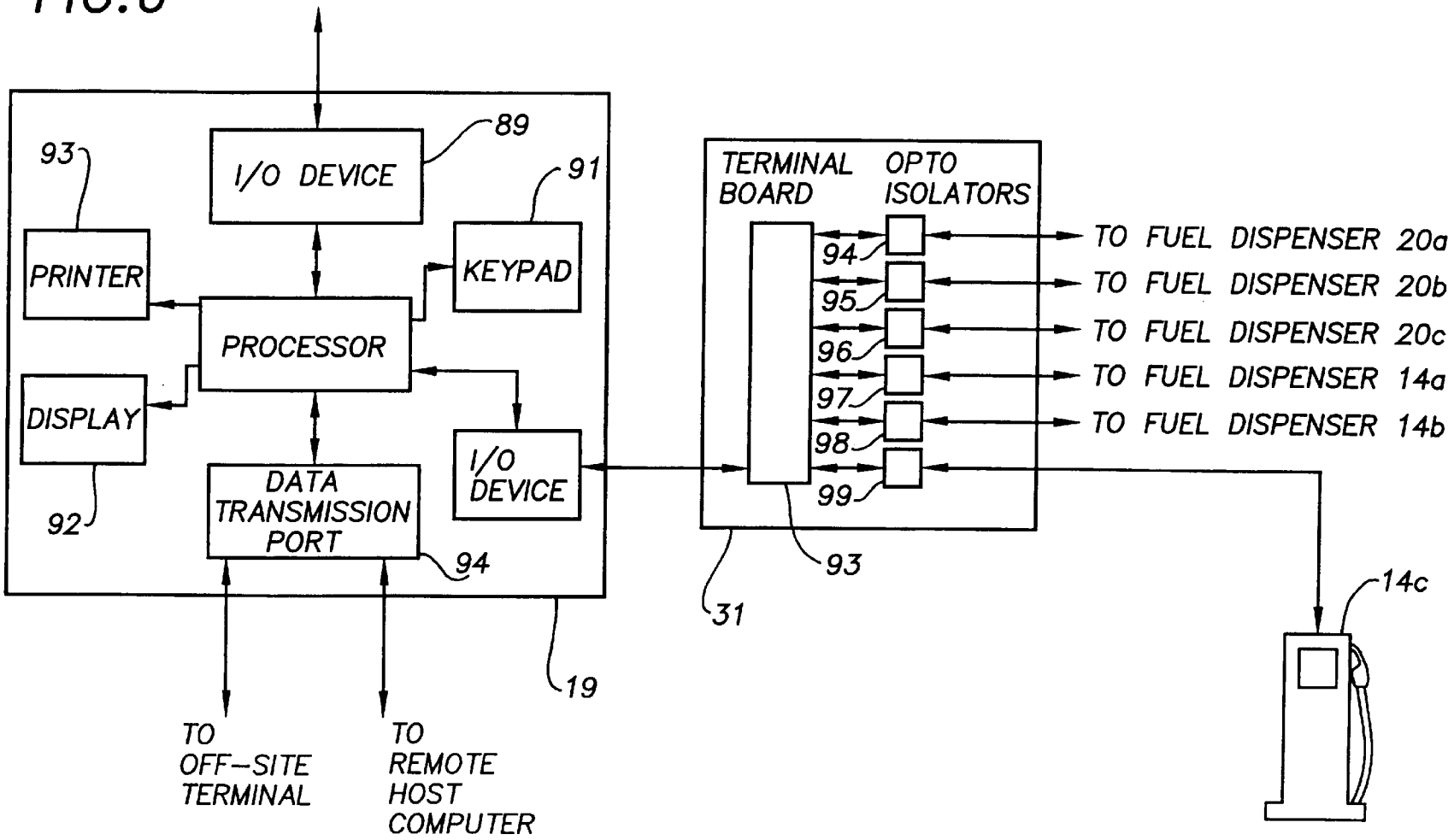
FIG. 6 is a functional block diagram illustrating the operation of the central terminal with one fuel dispenser.

FIG. 6 is a functional block diagram showing the interface between the central master terminal 19 and the individual fuel dispensers. The communications link is established through a junction box 31 using an SDLC protocol in accordance with a conventional RS-485 line or a custom protocol developed by the fuel dispenser manufacturer. The junction box 31 is similar to that described above for the junction box 30 between the island transaction terminals and the controller device. The output of the central master terminal 19 is split out at a terminal board 93 to each individual fuel dispenser. Preferably, six conventional opto isolators 94–99 are employed to isolate the central master terminal 19 and to minimize the induced noise on the communications lines 14*a–c*, 21*a–c*. It will be appreciated that alternative isolation circuits may be employed such as transformers or the like. An example of a junction box 31 suitable for use in this embodiment is a 69B interface box manufactured by Tokheim Corporation, Fort Wayne, Ind.

In the embodiment employing the SDLC protocol between the central master terminal 19 and the fuel dispensers, the central master terminal 19 polls or selects the fuel dispenser through the address frame. An enable signal is encoded in the information frame accompanying the address. A conventional fuel dispenser receives the SDLC encoded signal and compares the address frame with an internal address to determine whether it has been enabled. In the event a match occurs, the data contained in the information frame is extracted which in turn allows the consumer to dispense fuel therefrom.

The processor 90 monitors the actual quantity of fuel dispensed from the selected fuel dispenser. The processor 90 continuously compares the actual quantity of fuel dispensed with the authorized quantity of fuel stored in memory. Once the actual quantity of fuel dispensed equals the authorized quantity of fuel, a disable signal is encoded in the information frame causing the selected fuel dispenser to terminal further dispensing of fuel. In the event that the consumer ceases dispensing fuel prior to dispensing the authorized quantity of fuel in a cash payment transaction, the processor 90 will computer the cash equivalent of the difference between the actual quantity of fuel dispensed and the authorized quantity of fuel to determine the refund due to the consumer. The microprocessor will display the amount of refund on the LCD 92 to indicate to the attendant the amount of cash to refund to the consumer. The amount of refund will also be transmitted back to the island transaction terminal for printing of a receipt as described in detail above.

Turning to FIG. 4, a power supply 81 provides power to the controller device 24 and is preferably connected to the UPS (not shown) for providing standby power in the case of a power failure. The UPS should have the capability for delivering power to the controller for approximately 15 minutes after a power interrupt is detected so that the attendant may complete the pending transactions. A simple way to implement this function would be to connected the power supply 81 to the back-up power source in the UPS through a steering diode (not shown) to charge the back-up power source during normal operation.

Figure 7:
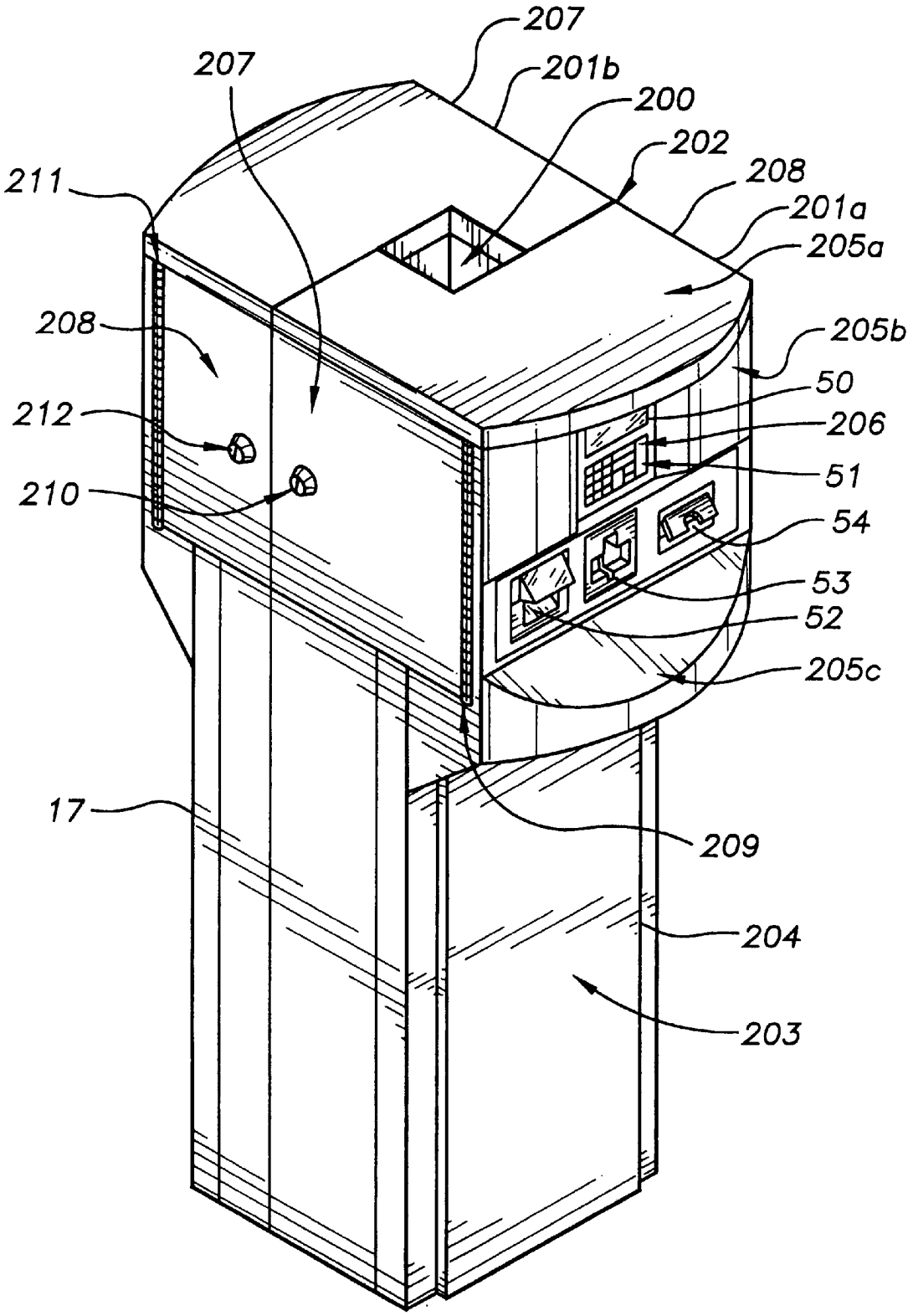
FIG. 7 is a top side front perspective view of an island transaction terminal constructed in accordance with the present invention.
Figure 9:
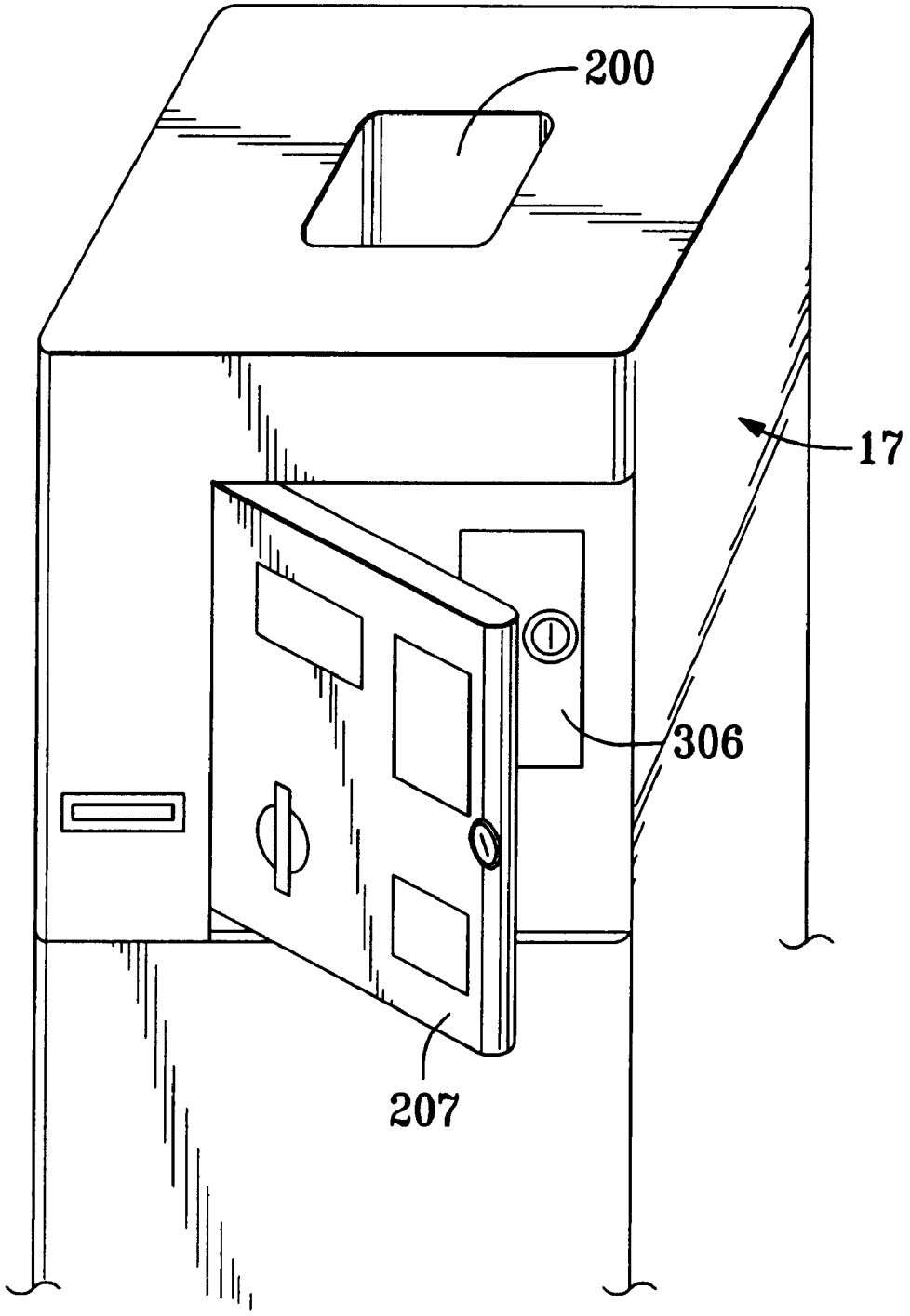
FIG. 9 is a perspective detail view of the upper portion of an island transaction terminal having features of the invention.
Figure 10:
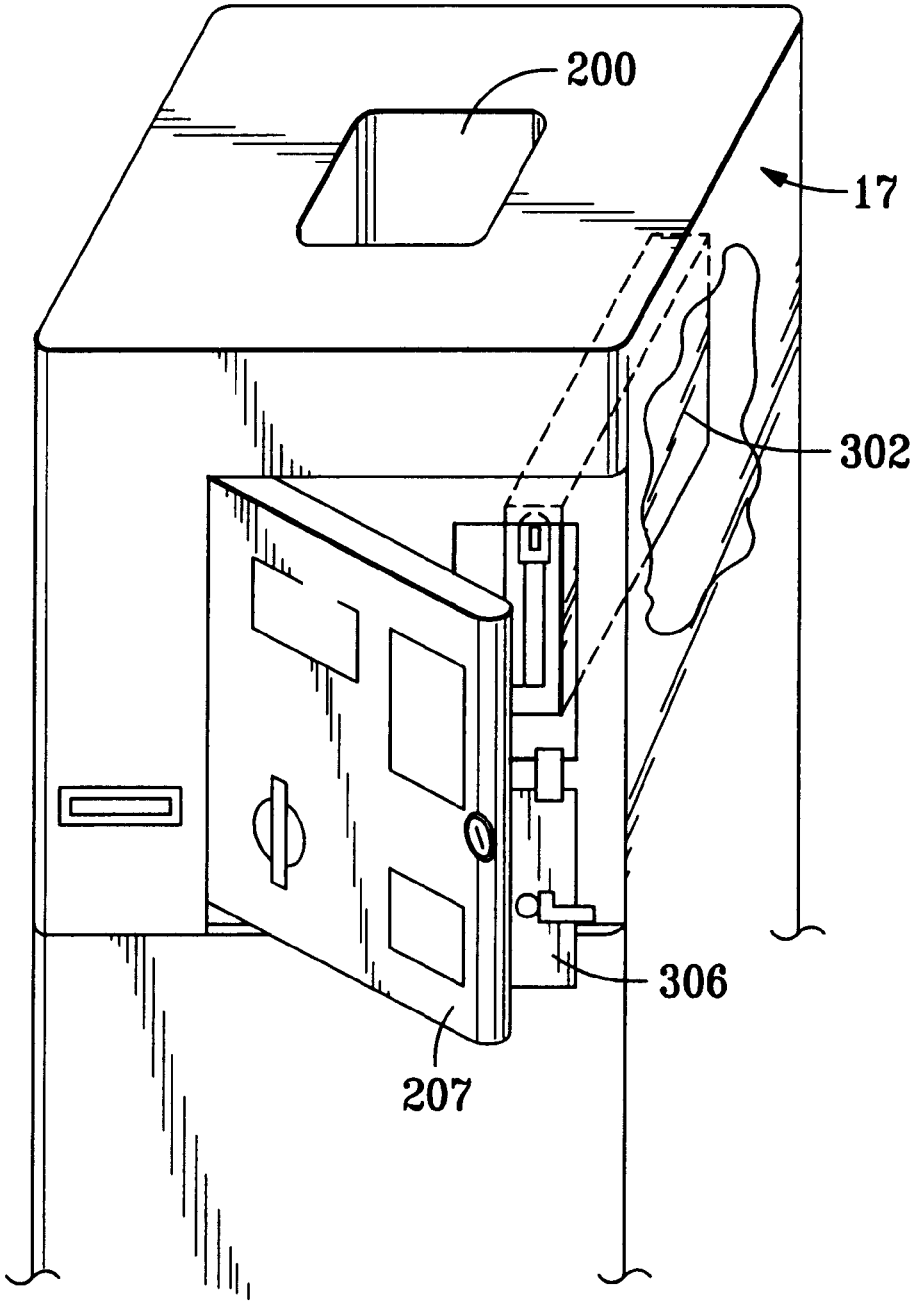
FIG. 10 is a perspective detail view in partial cutaway showing features of the island transaction terminal shown in FIG. 10.

FIG. 7 is a top side front perspective view of an island transaction terminal 17 constructed in accordance with the present invention. FIGS. 9 and 10 are detail views of preferred embodiments of the island transaction terminal 17. In the described embodiment, the island transaction terminal 17 is a separate, free standing, customer-operable point-of-sale terminal having a hole 200 defined in about its center for accommodating a support post 301 or similar vertical member around which the island transaction terminal 17 is installed. The support post 301 can be a support post for the canopy covering the fuel dispensing pump islands for another part of the gasoline station 11. The support post 301 is securely attached to the earth, such as by being set in an underground concrete footing.

The island transaction terminal 17 is preferably constructed in two sections 201*a* and 201*b*. Each section 201*a*, 201*b* is maneuvered around the support post and fitted together at seam 202 and fixedly secured together internally using bolts, weld points or other forms of fasteners.

Each of the sections 201*a*, 201*b* are equipped with a point-of-sale terminal such as shown in FIG. 3. Thus, when sections 201*a* and 201*b* are combined, a pair of back-to-back point-of-sale terminals are formed. This enables simultaneous transacting of fuel purchases at a single island transaction terminal 17.

The island transaction terminal 17 is preferably constructed in a robust manner that is both durable and aesthetically pleasing. In the described embodiment, the base section 203 is formed out of sheets of steel, preferably stainless steel. A lower front panel 204 is fixedly attached to the front of the island transaction terminal 17; however, it can be removably attached using fasteners accessible through the interior of the island transaction terminal 17.

The point-of-sale terminal is surrounded by a 3-piece covering 205*a*, 205*b*, 205*c*. It comprises a top cover 205*a*, an upper cover 205*b* and a lower cover 205*c*. In the described embodiment, these are formed of plastic. Preferably, the upper section 205*b* bows outwardly in a concave fashion with a recess 206 formed around the LCD display 50 and keypad 51 whereby viewing of the LCD display 50 and keypad 51 are obscured by the upper section 205*b* and thereby prevents would-be card thefts from viewing PIN numbers as they are entered. In addition, the lower cover 205*c* provides a convenient ledge for resting purses and so forth while transacting with the island transaction terminal 17 and provides damage protection to the cash acceptor 52, card reader 53 and receipt printer 54 from damage from below.

To enable authorized personnel to service the components within the island transaction terminal 17 and to retrieve the cash cartridge 302 for each of the cash acceptors 52, the island transaction terminal 17 is preferably equipped with a pair of access doors 207 and 208. The access door 207 is used for retrieving the cash cartridge 302 for the cash acceptor 52 of 201*a*. Preferably, the access door 207 is attached to the island transaction terminal 17 with a hinge assembly 209 and secured using lock mechanism 210. In the described embodiment, the lock mechanism 210 is preferably a screw-type lock which requires a plurality of full turns to unlock. The access door 208 provides access to the components making up the point-of-sale terminal of section 201*b* and is used, for instance, to clear paper jams or to reload paper in the receipt printer 54 and for other service-related operations. The access door 208 is attached to the island transaction terminal 17 using a hinge assembly 211 and secured with a lock mechanism 212. An identical pair of access doors 207 and 208 are found on the opposite side of the island transaction terminal 17 for access to the cash acceptor 52 of section 201*b* and for the components of the point-of-sale terminal of section 201*a*. Preferably, the cash cartridge 302 is locked behind an inner door 306.

Preferably, the island transaction terminal further comprises an alarm which is adapted to sound when the outer access door is opened unless the alarm is disabled by keying in a specific code on the key pad.

It is also preferable that the inner door 306 and outer door 207 are lockable by different keys and each of the locks are double tumbler locks.

The actual dimensions of the island transaction terminal 17 are not critical. However, in the described embodiment, the hole 200 is 6 inches wide and 8 inches deep and runs the full height of the island transaction terminal 17. The overall dimensions of the base section 204 is about 20 inches wide and about 18 inches deep. The overall depth of the island transaction terminal from the face of the point-of-sale terminal of section 201*a* to the face of the point-of-sale terminal of section 201*b* is about 24 inches. The overall height is about 55 inches. The LCD display 50 and keypad 51 are located about 4 to 10 inches from the top and the cash acceptor 52, card reader 53 and receipt printer 54 are located between 10 and 16 inches from the top. Other arrangements of the components and variations on the structure of the island transaction terminal 17 may also be used.

Figure 8:
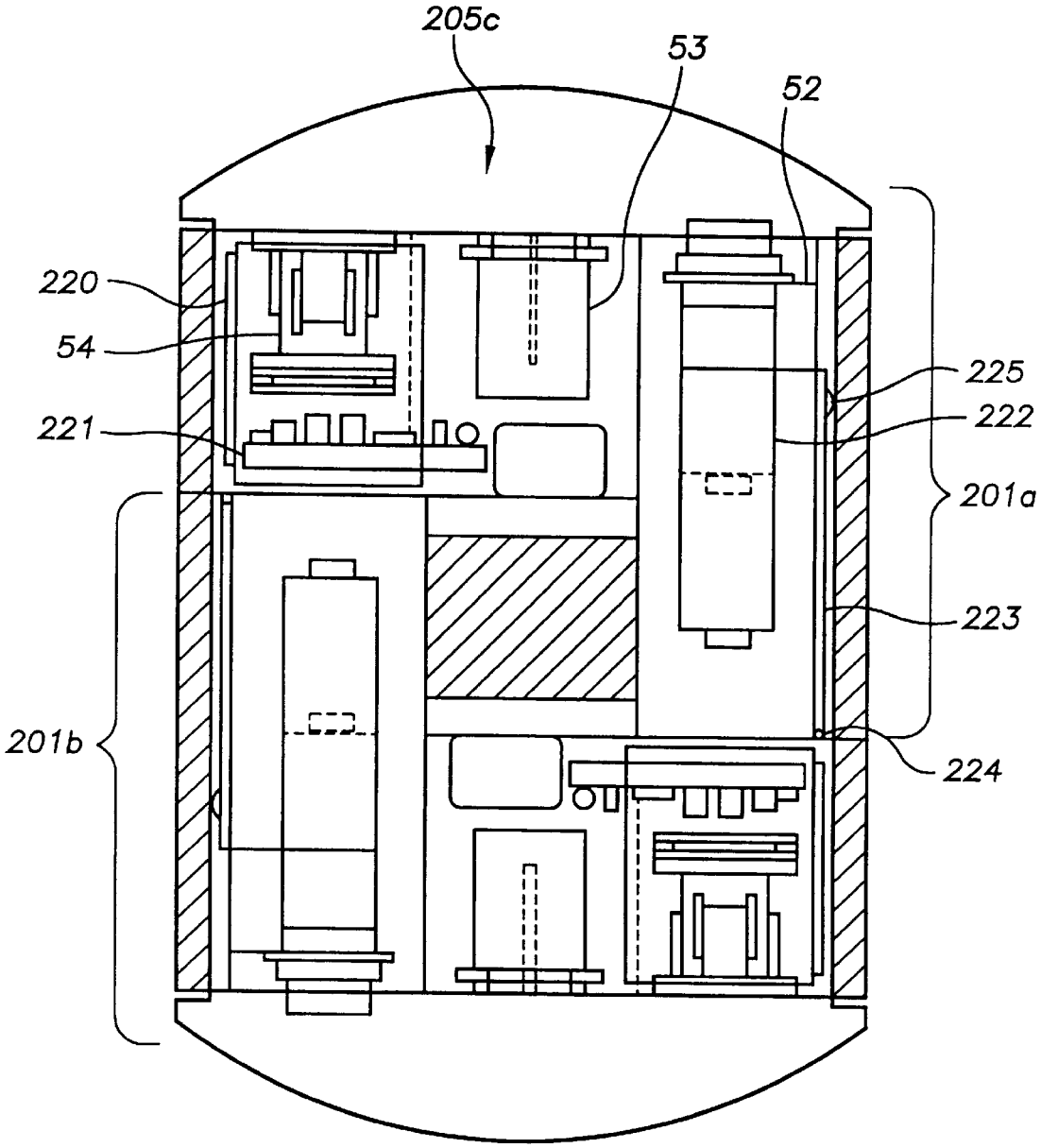
FIG. 8 is a top plan view of the island transaction terminal of FIG. 7 with the top cover removed.

FIG. 8 is a top plan view of the island transaction terminal 17 of FIG. 7 with the top cover 205*a* removed. Although both sections 201*a* and 201*b* are shown (since they contain identical components), only section 201*a* will be discussed. In the described embodiment, the point-of-sale terminal is housed in a chassis 220 to form an integral unit having a cash receptor 52, a card reader 53, a receipt printer 54 and a data encryption module 59 having the LCD display 50 and the keypad 51. A controller board 221 contains both the processor 57 and a power supply for powering the cash acceptor 52, the card reader 53, the receipt printer 54 and the data encryption module 59. The power supply is preferably connected to a UPS such as described hereinabove. Each island transaction terminal 17 should be connected to a UPS; however, the same UPS used with the controller device 24 can also be used with one of the island transaction terminals 17, 18. An example of a UPS suitable for use with the island transaction terminal 17 and the controller device 24 is a model number BK 1250 manufactured by APC.

The chassis 220 is preferably formed from sheet metal. In addition, the chassis 220 is preferably equipped with an inner door 223 attached with hinge assembly 224 and secured by lock mechanism 225 for providing access to the cash cartridge 222 of the cash acceptor 52. The inner door 223 is preferably situated behind the access door 207 and equipped with a different key than that used with the lock mechanism 210. This prevents unauthorized personnel from tampering with or removing the cash cartridge 222 while still allowing access to the components of the island transaction terminal from the other side.

Figure 11:
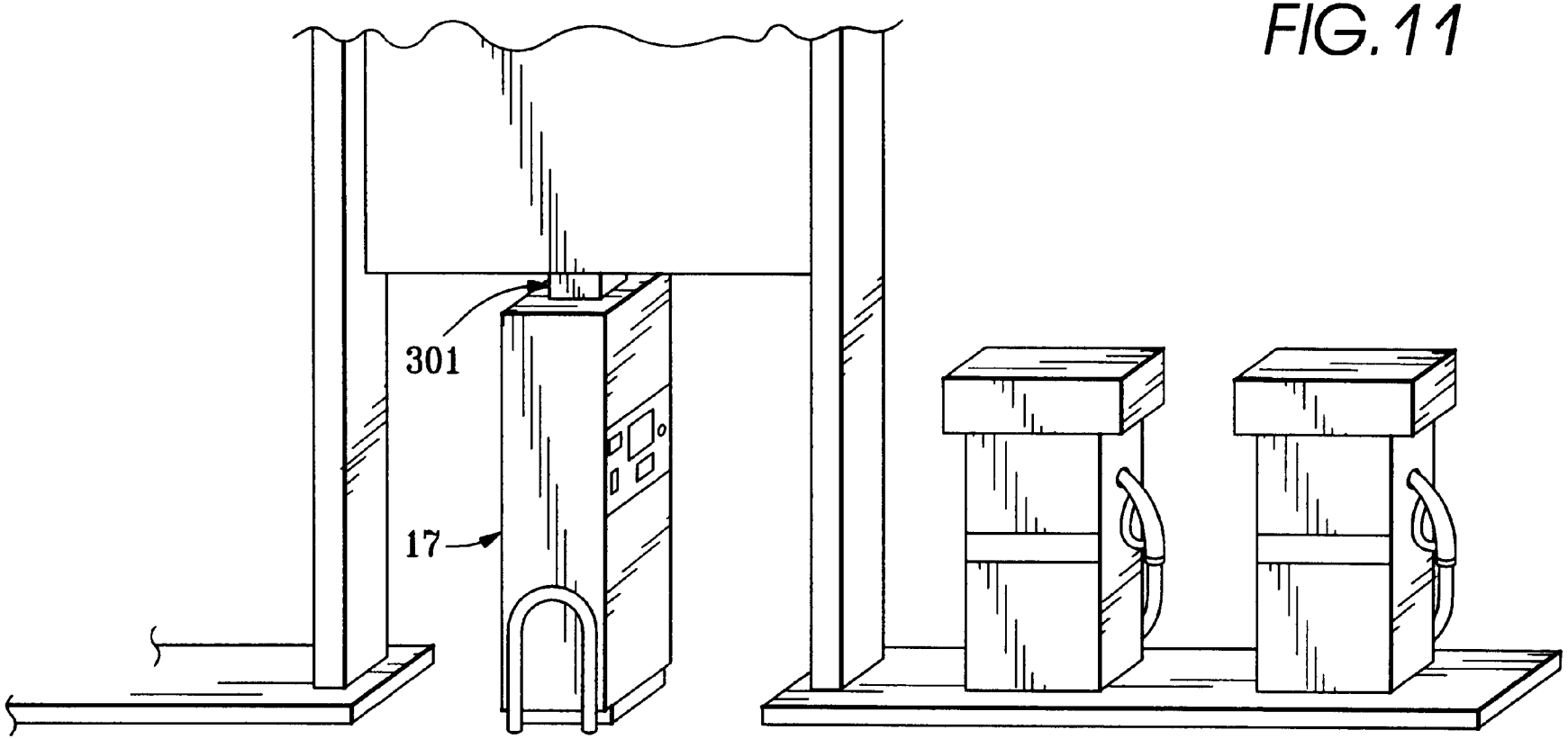
FIG. 11 is a perspective drawing of a fuel dispenser island including an island transaction terminal having features of the invention.

As shown in FIG. 11, it is preferable that the island transaction terminal be disposed between side posts 303, such as the U-shaped side posts 303 shown in FIG. 11. Such side posts 303 are preferably firmly attached to the earth, such as by being set in concrete disposed below ground. The side posts 303 are disposed in close proximity to a wall of the island transaction terminal so that it is difficult to physically remove the island transaction terminal from its location.

It is apparent from the foregoing that the present invention satisfies an immediate need for an improved customer-operable POS terminal providing a cash payment acceptor and a non-cash payment acceptor. This system may be embodied in other specific forms and used with a variety of dispensing products without departing from the spirit or essential attributes of the present invention. Therefore, the described embodiments are to be considered in all respects as illustrative and not restrictive, reference being made to the appended claims rather than the foregoing description to indicate the scope of the invention.

What is claimed is:

1. An island transaction terminal useable in a system for transacting fuel purchases, the island transaction terminal comprising:

means for receiving a request for purchasing fuel at a specified dispensing pump, means for receiving payments for such fuel purchase in the form of money or money equivalent and means for emitting a first payment signal containing information regarding the amount of payment received, the form of payment and the specified dispensing pump for which such fuel purchase is requested;

wherein the island transaction terminal defines a vertical bore, so that the island transaction terminal can be securely affixed to a rigid post at the island location by attaching the island transaction terminal around the post such that the post is disposed within the bore, and wherein the island transaction terminal is constructed in two vertical sections each defining a portion of the vertical bore and the two vertical sections are secured to one another with a vertical post disposed within the bore.

2. The island transaction terminal system of claim 1 wherein the means for receiving payments within the island transaction terminal comprises a cash box cartridge which can be quickly removed and replaced with an identical cash cartridge.

3. The island transaction terminal system of claim 2 wherein the cash box cartridge is disposed within a lockable first chamber having a lockable inner door and wherein the first chamber is disposed within a lockable second chamber having a lockable outer door.

4. The island transaction terminal system of claim 3 wherein the cash box cartridge is lockable by a method different than the method used to lock the inner door and the outer door.

5. The island transaction terminal system of claim 2 further comprising a key pad and an alarm disposed within the island transaction terminal, the alarm being adapted to sound when the outer door is opened unless the alarm is disabled by keying in a specific code on the key pad.

6. The island transaction terminal system of claim 3 wherein the inner door and the outer door are lockable by different keys and the locks are double-tumbler locks.

7. The island transaction terminal system of claim 1 wherein the island transaction terminal is disposed around a rigid post which is firmly attached to the earth.

8. The island transaction terminal system of claim 7 further comprising side posts firmly attached to the earth, the side posts being disposed on opposite sides of the island transaction terminal in close proximity to a side wall of the island transaction terminal.

9. An island transaction terminal useable in a system for transacting fuel purchases, the island transaction terminal comprising:

means for receiving a request for purchasing fuel at a specified dispensing pump, means for receiving payments for such fuel purchase in the form of money or money equivalent, wherein the means for receiving payments comprises a cash box cartridge which can be quickly removed and replaced with an identical cash cartridge; and, means for emitting a first payment signal containing information regarding the amount of payment received, the form of payment and the specified dispensing pump for which such fuel purchase is requested;

wherein the island transaction terminal defines a vertical bore, so that the island transaction terminal can be securely affixed to a rigid post at the island location by attaching the island transaction terminal around the post such that the post is disposed within the bore, and wherein the island transaction terminal further comprises a key pad and an alarm disposed within the island transaction terminal, the alarm being adapted to sound when the outer door is opened unless the alarm is disabled by keying in a specific code on the key pad.

* * * * *

UNITED STATES PATENT AND TRADEMARK OFFICE
CERTIFICATE OF CORRECTION

PATENT NO.: 6,092,629

DATED: July 25, 2000

INVENTOR(S): Michael H. Bohnert, Ronald R. Lien

It is certified that error appears in the above-identified patent and that said Letters Patent is hereby corrected as shown below:

| Col. | Line | |
|---|---|---|
| 5 | 1 | "journal printers 46b, 46b"<br><br>should read:<br>"journal printers 46a, 46b" |
| 5 | 10 | "system is describe din U.S."<br><br>should read:<br>"system is described in U.S." |
| 6 | 14 | "control access the cash"<br><br>should read:<br>"control access to the cash" |
| 6 | 40,41 | "module 59 conforms to"<br><br>should read:<br>"module 59 which conforms to" |

UNITED STATES PATENT AND TRADEMARK OFFICE
CERTIFICATE OF CORRECTION

PATENT NO.: 6,092,629

DATED: July 25, 2000

INVENTOR(S): Michael H. Bohnert, Ronald R. Lien

It is certified that error appears in the above-identified patent and that said Letters Patent is hereby corrected as shown below:

| Col. | Line | |
|---|---|---|
| 10 | 5 | "fuel dispenser to terminal"<br><br>should read:<br>"fuel dispenser to terminate" |
| 10 | 9 | "**90** will computer the cash"<br><br>should read:<br>"**90** will compute the cash" |
| 10 | 24 | "would be to connected the"<br><br>should read:<br>"would be to connect the" |
| 10 | 30 | "10 are detail views of"<br><br>should read:<br>"10 are detailed views of" |

UNITED STATES PATENT AND TRADEMARK OFFICE
CERTIFICATE OF CORRECTION

PATENT NO.: 6,092,629

DATED: July 25, 2000

INVENTOR(S): Michael H. Bohnert, Ronald R. Lien

It is certified that error appears in the above-identified patent and that said Letters Patent is hereby corrected as shown below:

| Col. | Line | |
|---|---|---|
| 12 | 57 | "vertical sections each defining"<br><br>should read:<br>"vertical sections, each defining" |
| 12 | 58 | "vertical bore and the two"<br><br>should read:<br>"vertical bore, and the two" |

Signed and Sealed this

Seventeenth Day of April, 2001

*Attest:*

Nicholas P. Godici

NICHOLAS P. GODICI

*Attesting Officer*

*Acting Director of the United States Patent and Trademark Office*